US005652734A

United States Patent [19]

Fish

[11] Patent Number: 5,652,734

[45] Date of Patent: Jul. 29, 1997

[54] DIRECTIONAL SOUND SIGNALING DEVICE

[76] Inventor: Richard I. Fish, 6477 Robert St., West Palm Beach, Fla. 33413

[21] Appl. No.: 593,701

[22] Filed: Jan. 29, 1996

[51] Int. Cl.[6] ..... H04R 13/00

[52] U.S. Cl. ..... 367/142; 116/26

[58] Field of Search ..... 367/142, 141; 116/26, 27, 169

[56] References Cited

U.S. PATENT DOCUMENTS

| | | | |
|---|---|---|---|
| 4,278,248 | 7/1981 | Kifferstein | 446/419 |
| 5,187,691 | 2/1993 | Oehme et al. | 367/142 |

*Primary Examiner*—Daniel T. Pihulic
*Attorney, Agent, or Firm*—McHale & Slavin, P.A.

[57] ABSTRACT

An improved manually operated signaling device to produce audible sound underwater. An air tight housing comprising a tubular member with end-caps permanently sealing each of its two ends and having contained within a metal echo-chamber fixed at each end of the housing plus a solid metal piston member. The inside diameter at each end of the housing is step-relieved so as to accept and hold fast the outside diameter and depth of the echo-chambers. The echo-chamber is a cylinder having one end open and one end closed with its closed end inserted into the ends of the housing. The outside diameter of the piston is slightly smaller than the inside diameter of the housing. The piston also has a length greater than its own diameter which allows the piston free movement along the longitudinal axis of the housing. A colored thin walled jacket may optionally cover a part or all of the housing exterior. A ring may be connected to the exterior of one of the housing end-caps for attaching a lanyard. The housing, end-caps and jacket are preferably made of polyvinyl chloride commonly referred to as PVC. The housing end-cap ring and piston are preferably made of stainless steel. The echo-chamber is preferably made of a malleable metal. A method of use is to aim the longitudinal axis of the housing toward another diver and shake the device with a reciprocal movement causing the piston to move along the longitudinal axis of the housing thus creating audible sound as the metal piston forcibly impacts the echo-chambers.

12 Claims, 2 Drawing Sheets

DIRECTIONAL SOUND SIGNALING DEVICE

FIELD OF INVENTION

This invention relates to underwater sound generating devices, specifically to such devices which are used to communicate between skin-divers.

BACKGROUND OF THE INVENTION

The number of sport, professional and commercial divers is on the increase. Danger is ever present to all divers. The need to communicate between divers can vary from casual to life-threatening. Hand signals would be satisfactory if divers were always within reach of each other or always within one another's field of vision. Even when divers are separated by short distances hand signals can lack the ability to create attention and can be misread with results that include serious consequences. Thereafter, inventors have attempted to create a reliable and effective attention arresting sound generating apparatus. Electronic and electro-mechanical devices put themselves in immediate question because their intended use subjects them to a substantially hostile environment. Also, accidental damage to the housing can result from routine diver activity causing the housing to leak thereby rendering the device useless. Routine maintenance inspections, including battery replacement increase the human error factor thereby adding to the question of ongoing reliability. Those electronic and electro-mechanical devices which are manufactured in an attempt to most nearly overcome these shortcomings cost more to manufacture making them expensive to own. Accordingly, a manually operated signaling device is capable of providing desirable results at low end-user cost because simplicity of design makes it cheaper to manufacture.

One such device is found in the underwater signaling device of Oehme et al, U.S. Pat. No. 5,187,691 issued Feb. 16, 1993. Oehme discloses a water-tight cylindrical chamber with an end member at each end and containing therein a metal ball. The cylindrical chamber and end members are polyvinyl chloride commonly called PVC. The end members are covered with an outer surface one of which has a loop to receive a cord. Also, a foam sleeve is also provided over the cylindrical chamber so as to provide improved underwater hand holding ability. To signal with this apparatus a person shakes it back and forth causing the metal ball to strike the perpendicular surface of the end members. Oehem repeatedly describes the resulting sound as a rattle, wherein a rattle is usually defined as a succession of short sharp sounds.

This signaling device is flawed in several ways. The cylindrical chamber and end members are made of PVC which is substantially softer than the steel ball. The interior perpendicular surface of the end member walls directly receive the full impact of the steel ball. The ball being round has a very small point of contact at the perpendicular surfaces. The resulting sound of the steel ball striking the much softer PVC can only be described as a non-reverberating thud. Oehem covers the end members with an outer surface plus a foam sleeve over the entire length of the cylindrical chamber. This foam sleeve is intended for improved underwater handling. Notably, foam materials are used extensively for insulating against high and low temperatures. Also, textured foam and sheet foam are particularly effective in creating a sound deadening environment. While the hand holding aspect may be improved the foam sleeve and outer coverings of the end members definitely muffles the sought after end result, e.g. audible sound. Even with the end member coverings and foam sleeve removed the sound generated by Oehem's apparatus could not be recognized as a rattle (e.g. sharp sound). The sound would still be more of a non-resonating thud able to carry only a short distance. It is my opinion that the molecular structure of the PVC will detrimentally change as a result of being battered by the steel ball. Additionally, it is my opinion that heat is produced from the repeated battering causing the PVC to become more and more brittle until the PVC ruptures rendering the device useless.

OBJECTS AND ADVANTAGES

Accordingly, the present invention provides an improved underwater signaling device including the following:

(a) a tubular member with an end-cap permanently sealing each of its two ends thereby making it airtight without ever needing service;

(b) the tubular member having contained within two echo-chambers, each resembling a short straight-wall thimble with the closed end being first inserted into the open ends of the tubular member;

(c) the inside diameter of the tubular member is relieved to a diameter and depth to match the outside diameter and depth of an echo-chamber;

(d) a metal piston contained within having an outside diameter slightly smaller than the inside diameter of the tubular member and also having a length greater than its own diameter thereby allowing the piston member to move freely along the longitudinal axis of the tubular member;

(e) a metal ring connected to one tubular member end-cap for attaching a lanyard;

(f) a brightly colored thin-wall jacket covering part or all of the tubular member exterior making it easy to locate, if dropped, and for cosmetic appeal;

Further objects and advantages of this invention are to provide a device that comfortably fits a diver's hand regardless of age or gender.

Another object is to provide a device wherein the tubular member, end-caps and thin-walled jacket are preferably made of PVC with the echo-chambers being made of copper and the piston and end-cap ring preferably made of stainless steel.

Yet another object of the present invention is to provide a device which is durable, attractive, easy to manufacture and inexpensive to own.

Still a further object of the present invention is to couple a steel piston with a malleable metal echo-chamber. The malleable metal echo-chamber being battered by the steel piston will be shaped to more perfectly match the perpendicular face of the steel piston. With increased usage the device will develop a greater volume of sound.

Yet a further object of the present invention is to provide an echo-chamber that becomes a true echo-chamber only after the device is assembled. The open end of the echo-chamber faces outwardly along the longitudinal axis of the tubular member. The end walls of the end-caps become the-path-of-least-resistance for the exiting sound waves. This results in the sound waves being most strong along the longitudinal axis of the tubular member. Thus, a measure of control exists to directionally aim the sound.

BRIEF DESCRIPTION OF THE DRAWINGS

In the drawings, closely related figures will have the same number but different alphabetic suffixes. In the drawings, duplicate parts or surfaces will have the same number.

DETAILED DESCRIPTION OF THE PREFERRED EMBODIMENT

Figure 1:
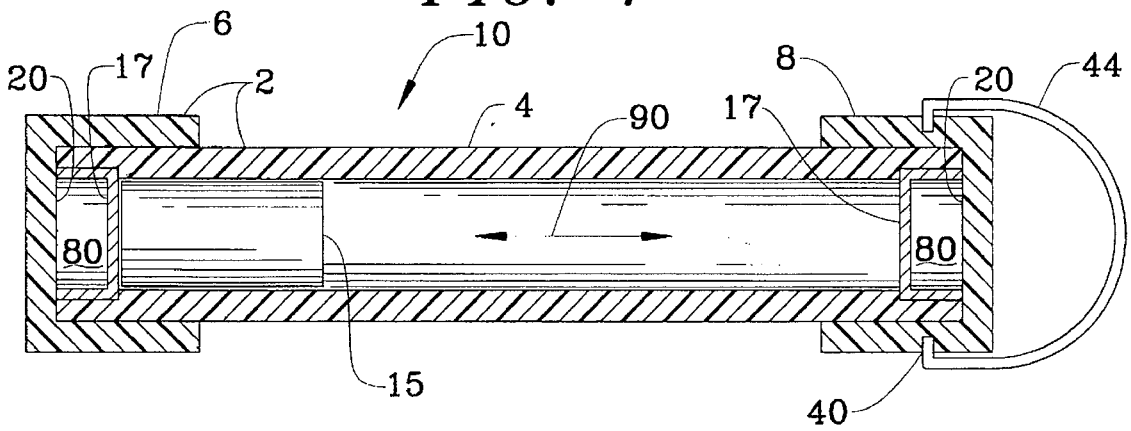
FIG. 1 is a full cross-sectional view of the sounding device.

In FIG. 1, device 10 is comprised of housing 2 including tubular member 4 with end-caps 6 and 8 permanently sealing each end of tubular member 4. End-cap 8 has two blind holes 40 located 180 degrees apart to receive and hold end-cap ring 44 which is provided to hold a lanyard, not shown. Housing 2 has contained therein a piston 15 which is preferably made of stainless steel plus an echo-chamber 17 at each end of housing 2 which are preferably made of copper. The outside diameter of piston 15 is slightly smaller than the inside diameter of housing 2. Also, piston 15 has a length greater than its own diameter which assures smooth and easy movement along the longitudinal axis of housing 2. The contact surface of the malleable copper echo-chamber 17 will become better matched to the striking face of piston 15. This will produce a greater volume of sound with continued use.

Figure 2:
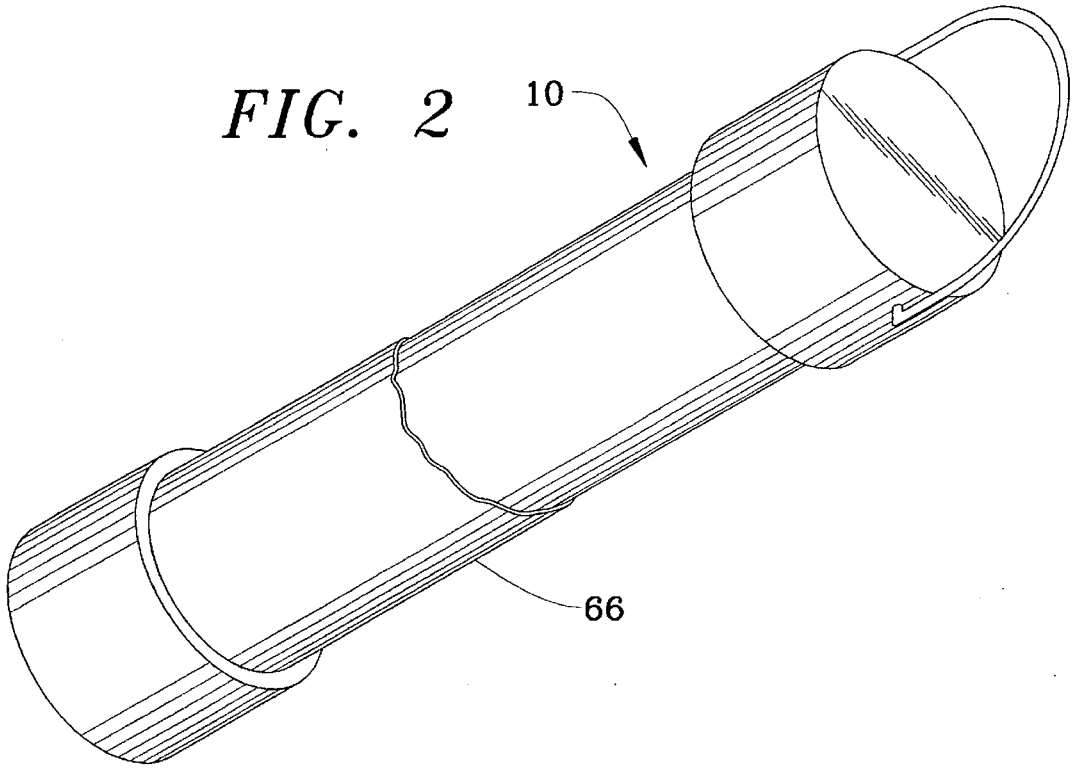
FIG. 2 is a perspective view of housing including a cut-away view of a thin walled jacket.

FIG. 2 shows a perspective view of device 10 with the thin walled jacket 66 cut away. Jacket 66 provides improved underwater gripping plus cosmetic value through a variety of bright colors. In FIG. 1, housing 2 has contained therein a piston 15 which is preferably made of stainless steel plus an echo-chamber 17 at each end of housing 2 which is preferably made of copper. The outside diameter of piston 15 is slightly smaller than the inside diameter of housing 2. Also, piston 15 has a length greater than its own diameter which assures smooth and easy movement along the longitudinal axis of housing 2. The contact surface of the malleable copper echo-chamber 17 will become better matched to the striking face of piston 15 which will produce a greater volume of sound with continued use.

Figure 3:
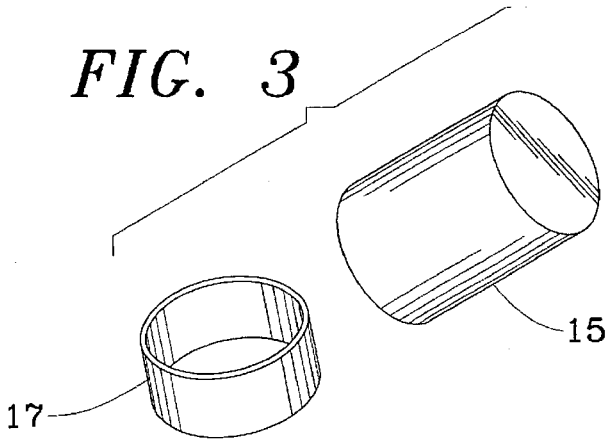
FIG. 3 is a perspective view of one echo-chamber plus the piston member.

FIG. 3 shows a perspective view of echo-chamber 17 plus piston member 15. Echo-chamber 17 has one open end. In the process of assembling end-cap 6 and 8, not shown, over tubular member 4, perpendicular surface 20 closes the open end of echo-chamber 17 creating the "chamber" 80 giving echo-chamber 17 the capacity to "echo".

Figure 4:
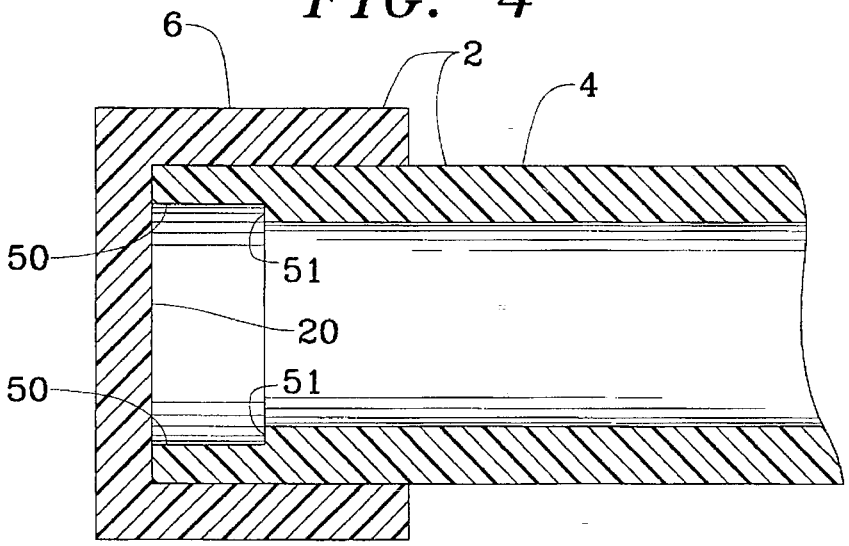
FIG. 4 is a partial cross-section view showing the housing minus the echo-chamber.

Referring now to FIG. 4, which shows the altered configuration at one end of tubular member 4 to hold echo-chamber 17, not shown. The outside diameter and depth of echo-chamber 17 snugly fits the enlarged diameter surface 50 and is stopped at the correct depth by surface 51.

Figure 4A:
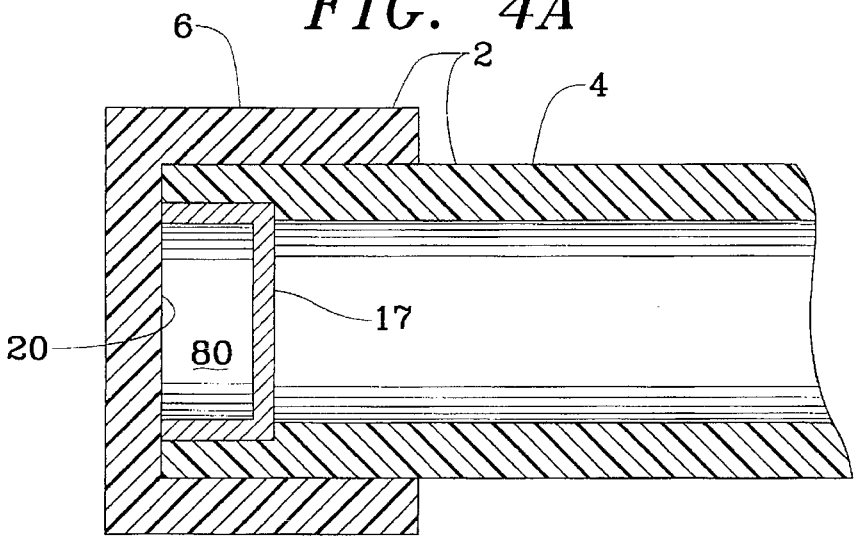
FIG. 4*a* is a partial cross-section view of the housing including the echo-chamber.

FIG. 4*a* shows the same view but with echo-chamber 17 in place. The closed end of echo-chamber 17 must be inserted into the open ends of tubular member 4. Along with this design, the end wall of end-cap 6 becomes the path-of-least-resistance through which sound waves will travel and be strongest.

Figure 5:
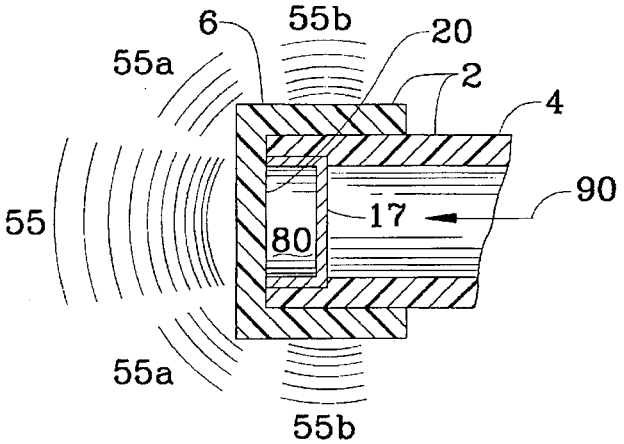
FIG. 5 is a partial cross-section view illustrating sound waves exiting the housing.

FIG. 5 depicts sound waves as they exit device 10. When sound is generated by piston 15 striking echo-chamber 17 the sound intensifies within chamber 80 and is strongest after leaving housing 2 along the path-of-least-resistance. The same sound waves are diminished after passing through the combined mass of end-cap side walls, tubular member side walls and echo-chamber side walls. These sound waves are illustrated as 55, 55*a* and 55*b*, with 55 being the strongest along the longitudinal axis 90 which coincides with the path-of-least-resistance. This unique combination of features effectively results in the sound waves being strongest in the direction of the longitudinal axis 90. Thus, a measure of control exists to aim the sound waves like a "flashlight".

While a variety of dimensions for the device might be used, the illustrated embodiment has an overall length of approximately 5–6 inches with an overall diameter of approximately 1–1¼ inches, a piston approximately ¾–1 inches long with a diameter approximately ½–¾ inches, an echo-chamber approximately ¼–7/16 inches long, and end-caps dimensioned to securely fit over the ends of the tubular member.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

I claim:

1. An underwater directional sound signaling device comprising:

an elongated tubular housing having a first open end spaced apart from a second open end by a predetermined length along a longitudinal axis, said tubular housing forming an interior chamber between said ends, said housing having an inner diameter;

a cylindrical metal piston with flat ends contained within the tubular housing;

at least one cylindrical metal echo-chamber means insertedly fixed along at least one of said ends of said tubular housing, said metal echo chamber means having an impact surface operatively associated with said piston ends for producing a resonant sound when said piston impacts said metal echo chamber means;

an end-cap member sealing each end of the tubular housing.

2. The underwater directional sound signaling device of claim 1 wherein said end-caps fit over and permanently seal the ends of said tubular housing creating an airtight housing.

3. The underwater directional sound signaling device of claim 2 wherein said housing is made of PVC.

4. The underwater directional sound signaling device of claim 2 wherein said housing has a tightly fitting brightly colored thin walled jacket.

5. The underwater directional sound signaling device of claim 1 wherein said housing has an inside diameter at each end, said metal echo chamber means has an outside diameter and a predetermined depth, and said inside diameter at each end of said tubular housing is enlarged to receive and securely hold said outside diameter and depth of said metal echo-chamber means.

6. The underwater directional sound signaling device of claim 1 wherein said metal echo-chamber means is a straight walled cylinder of malleable metal having a predetermined depth with one end open and one end closed, and having the closed end inserted into one of said open ends of said housing.

7. The underwater directional sound signaling device of claim 1 wherein said end-caps include a cylindrical wall and a perpendicular end wall, said walls having inside and outside surfaces, and wherein in the process of assembly the inside perpendicular surface of said end-caps closes off the open end of said echo-chambers thereby creating a sealed chamber.

8. The underwater directional sound signaling device of claim 1 wherein said piston is formed from stainless steel and has an outside diameter and length, said outside diameter being approximately fifteen percent smaller than said inside diameter of said housing and additionally said length being approximately fifty percent greater than said outside diameter of said piston.

9. The underwater directional sound signaling device of claim 1 wherein one said end-cap has a connecting means to attach a lanyard.

10. A method of signaling another diver using the device of claim 1 which includes the steps of:

hand holding said underwater directional sound signaling device so that its longitudinal axis is pointing in the direction of another diver;

shaking said device thereby reciprocatingly causing said metal piston ends to and repeatedly strike at least one said metal echo-chamber means thereby producing sound which is loudest along said longitudinal axis of said device.

11. The underwater directional sound signaling device of claim 1, which includes one said metal echo chamber means insertedly fixed at each end of said housing.

12. A method of signaling another diver using the device of claim 11 which includes the steps of:

hand holding said underwater directional sound signaling device so that said longitudinal axis is pointing in the direction of another diver;

shaking said device thereby reciprocatingly causing said metal piston ends to alternately and repeatedly strike at least one said metal echo-chamber means thereby producing sound which is loudest along said longitudinal axis of said device.

* * * * *